United States Patent [19]

Nyssen

[11] 4,161,811

[45] Jul. 24, 1979

[54] METHOD AND APPARATUS FOR THE MANUFACTURE OF REINFORCED SMOOTH FLOW PIPE

[76] Inventor: James Nyssen, 10045 Kenswood Dr., Chilliwack, British Columbia, Canada

[21] Appl. No.: 885,662

[22] Filed: Mar. 13, 1978

[51] Int. Cl.[2] ..... B23P 19/00; B23P 19/04

[52] U.S. Cl. ..... 29/429; 29/509; 29/514; 29/515; 29/781; 29/788; 29/564.1; 72/50; 138/154; 138/173

[58] Field of Search ..... 29/429, 509, 521, 781, 29/788, 796, 564.1, 505, 515, 514; 138/150, 154, 173; 72/49, 50

[56] References Cited

U.S. PATENT DOCUMENTS

| | | | |
|---|---|---|---|
| 1,117,687 | 11/1914 | McMurtrie | 29/564.1 |
| 3,263,321 | 8/1966 | Lombardi | 29/781 |
| 3,448,203 | 6/1969 | Somes, Jr. | 29/509 X |
| 3,474,514 | 10/1969 | Lombardi | 29/429 X |
| 3,477,891 | 11/1969 | Hawerkamp | 138/173 X |
| 3,487,537 | 1/1970 | Lombardi | 29/429 |
| 3,694,892 | 10/1972 | Hale | 29/509 X |
| 3,865,146 | 2/1975 | Meserole | 138/173 X |
| 4,070,886 | 1/1978 | Nyssen | 72/49 |
| 4,125,936 | 11/1978 | Rozmus | 29/509 X |

*Primary Examiner*—Charlie T. Moon
*Attorney, Agent, or Firm*—Lee & Smith

[57] ABSTRACT

A method and apparatus for the continuous manufacture of reinforced, spirally wound pipe having a generally smooth inner wall produced from an elongated flat sheet of ductile material, such as galvanized steel, and one or more narrow strips of ductile material. The sheet and strips are situated in rolls located at the entry end of a rolling apparatus which is constructed to form one longitudinal, generally trapezoidal reinforced impression in the sheet corresponding to each of the narrow strips. In the process of forming the impressions, rolling stands in the rolling apparatus first fashion a longitudinal, generally rectangular channel in the sheet corresponding to each strip as the sheet progresses through the rolling apparatus. At the same time, the strips are shaped into reinforcement elements having an extended, continuous portion and splayed legs extending outwardly from the edges of the continuous portion. After formation, each strip is inserted into its respective channel and the channel closed about the strip to form the trapezoidal impression. The reinforced sheet is then curled into adjacent, helical convolutions which are joined with an appropriate seam.

13 Claims, 16 Drawing Figures

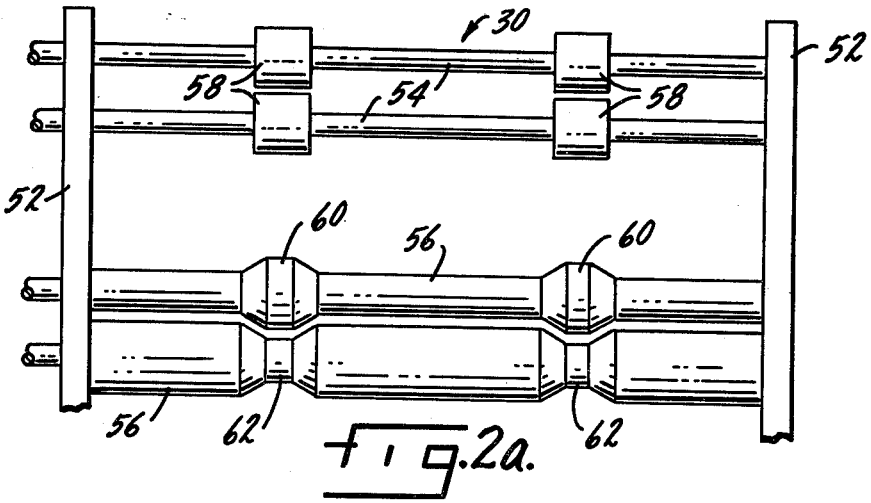
Fig. 2a.
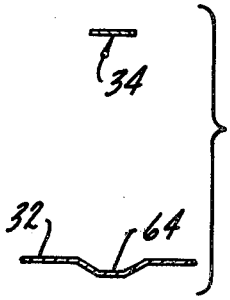
Fig. 2b.
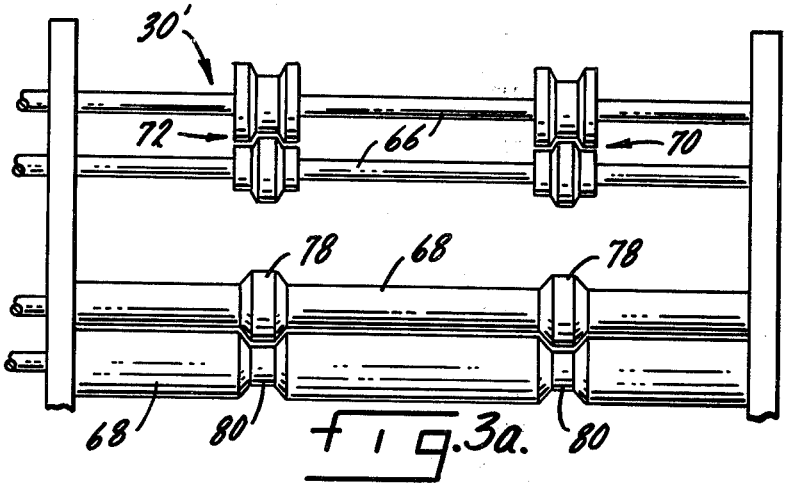
Fig. 3a.
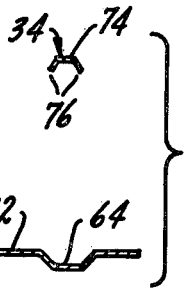
Fig. 3b.
Fig. 4a.
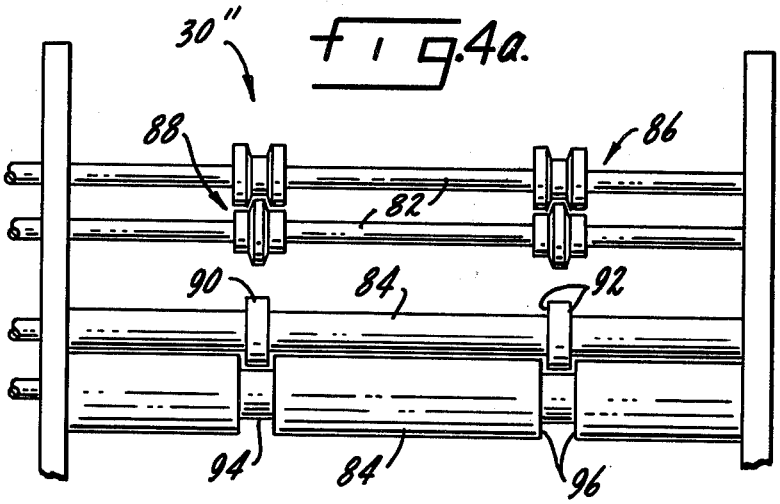
Fig. 4b.
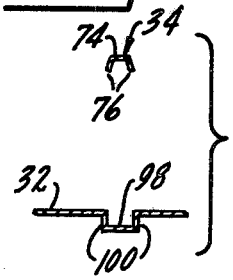
Fig. 5a.
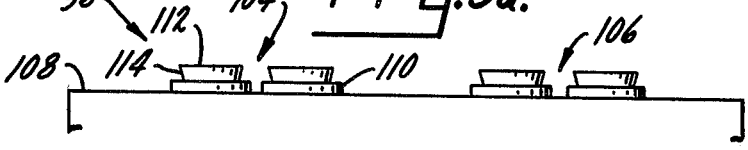
Fig. 5b.
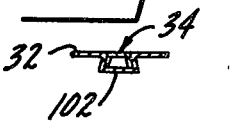

METHOD AND APPARATUS FOR THE MANUFACTURE OF REINFORCED SMOOTH FLOW PIPE

SUMMARY OF THE INVENTION

Related Subject Matter

This application is related in some respects to the applicant's U.S. Pat. No. 4,070,886 and U.S. patent application Ser. No. 867,139, filed Jan. 5, 1978 and entitled "Method And Apparatus For Making Multi-Layer Spiral Pipe", both of which are incorporated herein by reference.

The Background

This invention relates to a method and apparatus for the manufacture of spirally wound pipe products, and more particularly to a method and apparatus for forming a helical pipe having one or more strengthening ribs or impressions formed in the outer wall of the pipe.

Apparatus for forming spiral pipe from one or more elongated sheets of metal or other ductile material is well known. Such apparatus is illustrated, for example, in U.S. Pat. Nos. 1,659,754; 2,752,873; 3,093,103; 3,269,162 and 3,606,783.

In a conventional apparatus for producing a helical pipe product used as drainage culvert or the like, an elongated sheet of metal is impressed with longitudinal corrugations or other reinforcement profiles, and then spiralled into adjacent, helical convolutions which are joined either by welding or by formation of a continuous lock seam. One such apparatus for forming a spirally wound corrugated pipe is illustrated in the applicant's U.S. Pat. No. 4,070,886 entitled "Spiral Pipe Forming Machine With Device For Aligning Spiralling Rolls". The wall of such pipe is generally formed from a single thickness of metal.

Spiral pipe produced by such apparatus, although exhibiting sufficient load bearing capacity to be used as a drainage culvert located beneath roadways, dams and the like, suffers the disadvantage of having a corrugated inner wall. For example, the helically corrugated pipe produced by the apparatus of the applicant's above-identified U.S. patent has a single wall with common helical corrugations forming the inner and outer surfaces of the pipe. The result of a non-smooth inner wall is turbulent inhibition to the flow of liquids through the pipe, forcing the pipe user to select a larger diameter pipe than would be needed were the inner wall of the pipe smooth.

It has long been recognized by the prior art at a smooth pipe inner wall is desirable in order to promote smoother, laminar fluid flow in the pipe. In addition, the prior art has recognized the strength advantages of a corrugated pipe in combination with a smooth inner wall. For example, Lombardi U.S. Pat. Nos. 3,340,901 and 3,474,514 have disclosed a spiral pipe and apparatus for forming the pipe from at least two layers of metal including a corrugated pipe outer shell and a smooth pipe inner shell. Adjacent pipe convolutions are joined by a flat seam extending along a valley of the outer pipe shell, thereby leaving a smooth inner pipe wall. The applicant's U.S. patent application Ser. No. 867,139, filed Jan. 5, 1978, has disclosed a further refinement of the Lombardi-type pipe which has, among other features, a single corrugation in the inner wall of the pipe in order to strengthen the seam joining adjacent helical convolutions of the pipe.

Although the pipe produced by the Lombardi apparatus and the apparatus of the applicant's above-identified patent application has a generally smooth inner wall, multiple layer spiral pipe of this nature is often economically non-competitive with single-thickness corrugated pipe. The pipe, being formed of at least two thicknesses of prepared material, often is substantially more expensive per unit length than single-thickness corrugated pipe. Furthermore, double-thickness pipe such as that formed by the apparatus of the applicant's above-identified U.S. patent application can be more difficult to form than that formed by the apparatus of the applicant's U.S. Pat. No. 4,070,886. Since the sheets to be formed into the multiple thickness pipe are fairly thick, the pipe forming apparatus must be extremely strong in order to withstand the substantial stresses experienced in curling of the multiple layer sheet into adjacent pipe convolutions. In addition, the inner surface of the multiple layer pipe product, especially in smaller diameter pipe, may be dimpled or crimped due to stressive forces inherent in the spiralling operation for formation of the pipe. Also, formation of a double lock seam as disclosed by the Lombardi patents can be a tedious procedure if the edges of the corrugated and uncorrugated sheets do not exactly align during formation of lock seam elements on the edges of the sheet and final spiralling of the multiple layered sheets of material into adjacent pipe convolutions. Hence, multi-layer pipe, although solving many flow problems of corrugated pipe, is not without its own disadvantages.

The Invention

The above disadvantages of the prior art and others are overcome by the present invention which provides a method and apparatus for producing reinforced, spirally wound pipe with a single wall thickness and smooth inner wall which has at least the strength of the same size and gauge spirally corrugated pipe.

The pipe is manufactured from an elongated, flat sheet of ductile material and one or more narrow strips, also formed of ductile material. The sheet and strips are introduced into a rolling device which continuously formed one longitudinal, generally trapezoidal reinforced impression in the elongated, flat sheet corresponding to each of the narrow strips. At the same time, the strips are shaped into reinforcement elements, each having a first continuous portion of a lesser width than the width of the rectangular channel and a second continuous portion comprising a pair of splayed legs extending from the outer edges of the first portion. Each reinforcement element is then inserted into its corresponding rectangular channel in the elongated sheet and the neck of the channel is closed about the reinforcement element to form the trapezoidal impression. Thereafter, a forming device continuously curls the reinforced sheet into adjacent, helical convolutions which are joined in a seam.

Preferably, the forming device is composed of three individual rolls which are positioned in a triangular fashion transversely to the longitudinal axis of the sheet and which curl the sheet into convolutions. Two of the rolls are located outside of the helical convolutions and the third of the rolls is located within the convolutions. Each of the outer rolls includes an annular gap located in registration with each of the impressions formed in the reinforced sheet, the gap being of a sufficient depth to accommodate the impression. Each of the gaps is substantially wider than the width of the impression in order to accommodate the minimum transverse angular relationship between the longitudinal axis of the reinforced sheet and the two rolls which occurs when the minimum diameter pipe is manufactured by the apparatus.

Each of the two outer rolls can be shifted horizontally parallel to its central axis in order to align the gaps of the rolls with the impressions as the angular disposition between the longitudinal axis of the sheet and the axes of the rolls is varied in order to obtain varying pitch convolutions produced by the same apparatus. Additionally, at least one of the two rolls is mounted for vertical shifting in order to vary the diameter of the convolutions produced by the forming device. As is well known in the art, a diameter alteration for the pipe is effected by changing both the convolution pitch and convolution diameter.

In the preferred embodiment of the invention, a lock seam is employed to join adjacent convolutions of the pipe. Partial lock seam elements are formed in the marginal edges of the sheet prior to its being curled into convolutions. When the sheet is then curled into convolutions, the lock seam elements are engaged and the lock seam completed by a pair of seaming rolls.

BRIEF DESCRIPTION OF THE DRAWINGS

The invention will be described in greater detail with reference to the drawings, in which.

FIG. *5a* is a cross-sectional illustration taken along lines *5a—5a* of FIG. 1 with portions omitted for clarity, FIG. *5b* is a cross-sectional illustration of a portion of the sheet having the reinforcement element lodged therein immediately downstream of the apparatus illustrated in FIG. *5a*, FIG. *6a* is a cross-sectional illustration taken along lines *6a—6a* of FIG. 1 with portions removed, showing the apparatus for formation of partial lock seam elements at opposite edges of the reinforced sheet, FIG. *6b* is a broken cross-sectional illustration of the configuration of the sheet immediately subsequent to passing through the apparatus illustrated in FIG. *6a*, FIG. *7a* is a cross-sectional illustration taken along lines *7a—7a* of FIG. 1 illustrating a further step in formation of the partial lock seam elements at opposite edges of the reinforced sheet, FIG. *7b* is a broken cross-sectional illustration of the sheet immediately subsequent to passing through the apparatus illustrated in FIG. *7a*.

DETAILED DESCRIPTION OF THE INVENTION

Figure 1:
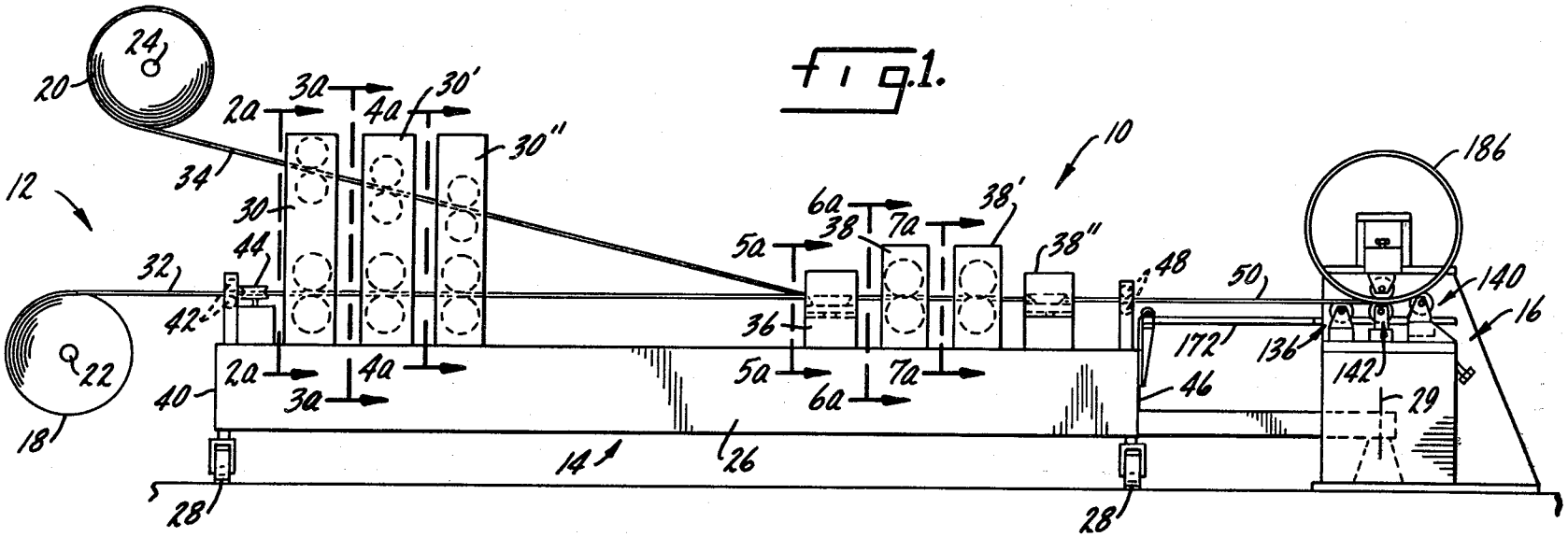
FIG. 1 is a schematic side elevational illustration of a pipe forming apparatus according to the invention, FIG. *2a* is a cross-sectional illustration taken along lines *2a—2a* of FIG. 1 with portions removed for clarity of explanation, FIG. *2b* is a cross-sectional illustration of one of the strips and a portion of the flat sheet immediately after being roll formed by the apparatus illustrated in FIG. *2a*, FIG. *3a* is a cross-sectional illustration taken along lines *3a—3a* of FIG. 1 with portions removed for clarity of explanation, FIG. *3b* is a cross-sectional illustration of one of the strips and a portion of the flat sheet immediately after being roll formed by the apparatus illustrated in FIG. *3a*, FIG. *4a* is a cross-sectional illustration taken along lines *4a—4a* of FIG. 1 with portions removed for clarity of explanation, FIG. *4b* is a cross-sectional illustration of one of the strips and a portion of the flat sheet immediately after being roll formed by the apparatus illustrated in FIG. *4a*.

Turning to the drawings, and in particular FIG. 1, the apparatus according to the invention is generally designated 10. It is composed of a decoiling device 12, a rolling or roll forming device 14 and a multiple roll pipe forming device 16. Apparatus not illustrated, but utilized in combination with the invention, as one skilled in the art will appreciate, is a cut-off device, such as the flying cut-off saw illustrated in the applicant's U.S. Pat. No. 3,815,455. The cut-off saw, or similar device, sequentially severs predetermined lengths of pipe emerging from the multiple roll pipe forming device 16 as the apparatus 10 is continuously operated.

The decoiling device 12, as schematically illustrated, includes a coiled continuous sheet 18 and at least one coiled continuous strip 20. The coils 18 and 20 are respectively mounted on central spindles or axles 22 and 24. Although not illustrated for the sake of simplicity of the drawing FIG. 1, each of the spindles 22 and 24 would be mounted in an appropriate framework to maintain the coils 18 and 20 in the positions indicated. Each of the coils 20 is mounted upon the central spindle 24 in a spaced relationship to align with forming rolls of the various forming strands of the rolling device 14, as described in further detail below.

The rolling device 14 consists of a carriage 26 mounted on a plurality of wheels 28 for pivoting relative to a pivot axis 29 located within the multiple roll pipe forming device 16. A series of roll forming stands 30, 30', 30'' are mounted on the carriage 26 and carry forming rolls (illustrated in detail in FIGS. *2a–4a*) for successively forming longitudinal impressions in a sheet of metal 32 as it emanates from the coil 18 and also in each strip 34 which emanates from the coils 20 and pass through the rolling device 14 (from left to right in FIG. 1). The carriage 26 also carries a reinforcement completion stand 36 and a series of seam element formation stands 38, each of which is discussed in greater detail below.

The sheet 32 enters the carriage 26 at its entry end 40, passing through a pair of pinch rolls 42 and a pair of edge guide rolls 44 which serve to align and steady the sheet 32 prior to its introduction into the roll forming stands 30 through 30''. At the exit end 46 of the carriage 26, a further pair of pinch rolls 48 serve to further steady the now-reinforced sheet 50 as it proceeds into the multiple roll pipe forming device 16.

Each of the roll forming stands 30, 30', 30'', completion stand 36, and seam formation stands 38 is provided motive power by a gear drive box (not illustrated) which in turn is connected to a motive source. Further detail of such driving means is contained in the applicant's U.S. Pat. No. 4,070,886 and above-identified U.S. patent application Ser. No. 867,139. Such driving means is conventional and will not be discussed further herein.

As illustrated in FIG. 1, as the sheet 32 emanates from the coil 18, the strips 34 issue from the coils 20. Both proceed through the roll forming stands 30 through 30'', are formed into appropriate configurations, and then joined just prior to the reinforcement completion stand 36. The multiple element sheet then continues through the remaining stands 36 and 38 through 38'', leaving the carriage 26 as the reinforced sheet 50.

The first of the roll forming stands is schematically illustrated in greater detail in FIG. *2a*. As illustrated, the stand 30 is composed of a pair of stanchions 52 attached to the carriage 26 (FIG. 1) and which retain a pair of upper forming rolls 54 and a pair of lower forming rolls 56. Each of the rolls 54 and 56 is journalled for rotation into bearings (not illustrated) mounted in the stanchions 52. The left end of each of the forming rolls 54 and 56 passes through the left stanchion 52 for driving attachment to an appropriate gear box, as explained above.

In the particular configuration illustrated in the drawing figures, the apparatus is constructed to accommodate a pair of strips 34 which are to be lodged in appropriate channels formed in the sheet 32. As illustrated in FIG. *2a*, each of the upper forming rolls 54 carries a pair of strip pinching rollers 58. The pinching rollers 58 serve as an initial guiding and aligning mechanism for each of the strips 34 issuing from the coil 20.

Immediately beneath the pinching rollers 58, the forming rolls 56 are shaped to initiate formation of the rectangular channels in the sheet 32. As illustrated, the upper of the rolls 56 includes a pair of increased diameter portions 60 and the lower of the rolls 56 includes a pair of complementary reduced diameter portions 62. The portions 60 and 62 cooperate to begin formation of a longitudinal channel in the sheet 32, as best illustrated in FIG. *2b* wherein one of the strips 34 is shown in position immediately above a portion of the sheet 32 which has formed therein a partial longitudinal channel 64. As would be obvious, were the entire sheet 32 illustrated subsequent to passing through the lower forming rolls 56 shown in FIG. *2a*, the sheet profile would include two of the partial longitudinal channels 64.

The second of the roll forming stands 30' is illustrated in FIG. *3a*. As the first stand 30, the second stand 30' includes a pair of upper forming rolls 66 and a pair of lower forming rolls 68.

Two pairs of conforming strip rollers 70 and 72 are mounted in cooperative relationship upon the upper forming rolls 66 as illustrated. The strip rollers 70 and 72 serve to begin deformation of the strip 34 as illustrated in FIG. *3b*, impressing into the strip an extended, continuous portion 74 and a pair of splayed legs 76 extending outwardly from opposed edges of the continuous portion 74.

Similarly, the upper member of the lower forming rolls 68 includes a pair of increased diameter portions 78 and the lower member of the rolls 68 includes a conforming reduced diameter portion 80. As the portions 60 and 62 of FIG. *2a*, the portions 78 and 80 serve to further deepen the partial longitudinal channels 64 in the sheet 32, as illustrated in FIG. *3b*.

In FIG. *4a*, the final strip and channel forming stand is schematically illustrated. As in the foregoing FIGS. *2a* and *3a*, the roll forming stand 30'' illustrated in FIG. *4a* includes a pair of upper forming rolls 82 and a pair of lower forming rolls 84.

The upper forming rolls 82 carry two pairs of conforming strip rollers 86 and 88 which cooperatively sandwich the strips 34 between them to complete information of the strip into the shape illustrated in FIG. *4b*. At this point, the continuous portion 74 remains of the same width as shown in FIG. *3b*, and the splayed legs 76 are steepened to a substantially vertical stance, though still spreading as depicted.

The upper member of the lower forming rolls 84 includes a pair of annular increased diameter portions 90 having generally vertical side walls 92. In conforming relationship, the lower member of the lower forming rolls 84 includes two reduced diameter portions 94 having generally vertical side walls 96. The resulting configuration of the sheet 32, having now completed rectangular channels 98 formed therein, is partially illustrated in FIG. *4b*. The rectangular channel 98 has a generally rectangular cross-sectional configuration conforming to the rolling profile of the increased portion 90 and reduced portion 94 of the lower forming rolls 84, with side walls 100 which are generally vertical.

For the purpose of forming trapezoidal impressions in the sheet 32, each of the continuous portions 74 of the strips 34 is of a lesser width than the width of the rectangular channels 98. The legs 76 are spread to approximately the same width as the rectangular channels 98, while the height of the strips is maintained about the same as the depth of the channels 98.

As shown in FIG. 1, subsequent to the forming stand 30'', the formed strips 34 are lodged in the rectangular channels 98 just prior to passing through the reinforcement completion stand 36. Appropriate rollers, not illustrated for the sake of simplicity and clarity in the drawing FIG. 1, may be utilized to urge the strips 34 into the channels 98 and retain them in such position as the sheet passes through the completion stand 36.

The longitudinal reinforcements in the sheet 32 are completed in the completion stand 36. It is the purpose of the completion stand to close the side walls of the rectangular channels 98 about each strip 34 to lock the strips therewithin and form a generally smooth upper sheet surface for later spiralling into helical convolutions as the interior of the formed pipe. Since the continuous portion 74 is of a lesser width than the width of the base of the channel 98, the completion stand 36 forms a generally trapezoidal impression 102 in the sheet 32 as illustrated in FIG. *5b*. The completion stand 36 includes two pairs of closure rollers 104 and 106, each located in registration with the channel 98 as formed by the preceding stands 30 through 30''. Each pair of rollers 104 and 106 is identical, and attention will be directed to the pair 104, it being evident that identical features are carried by the pair of closure rollers 106.

Each of the rollers 104 is rotatable about a central vertical axis (not illustrated), and is securely mounted for rotation upon a frame 108. Each roller is shaped to include an annular shoulder 110 and a reduced diameter segment 112 having declining annular walls 114 defining a gap therebetween for pinching the rectangular channel 98 closed about the strip 34 into the trapezoidal impression 102 illustrated in FIG. *5b*.

After the requisite number of impressions 102 are formed in the sheet 32, the sheet progresses through the successive seam element formation stands 38 through 38''. Seam formation is accomplished in three steps in the same manner as described in the applicant's aforementioned U.S. patent application Ser. No. 867,139.

In the stand 38, as best illustrated in FIG. *6a*, seam element formation is commenced by passing the now reinforced sheet 50 between a pair of rolls 116 having keyed thereon, looking downstream in the direction which the sheet travels, left complementary seam element rollers 118 and right complementary seam element rollers 120. The rollers 118 and 120 engage the respective left and right marginal edge portions of the sheet 50 and commence the formation of left and right seam elements 122 and 124 as shown in FIG. *6b*. At the same time, the rollers 120 begin formation of a slight depression 126 in the right marginal portion of the sheet.

In FIG. *7a*, the second seam element formation stand 38' is schematically illustrated, having, in the same fashion as the stand 38 of FIG. *6a*, a pair of rolls 128 having left complementary seam element rollers 130 and right complementary seam element rollers 132. The rollers 130 and 132 serve to further shape the marginal edge portions of the sheet 50, forming the left and right seam elements 122 and 124 in generally vertical positions as illustrated schematically in FIG. *7b*. At the same time, the rollers 132 deepen slightly the depression 126 and the rollers 130 form a longitudinal heel 134 in the sheet, which will be described in further detail in connection with FIG. 10. The depth of the depression 126 beneath the level surface of the sheet 50 is formed by the rollers 132 to be approximately three thicknesses of the sheet 50 deep, in order to accommodate the lock seam, also described further with relation to FIG. 10.

Finally, the stand 38'', not shown in additional detail, serves to bend the left and right seam elements 122 and 124 over further to approximately 45° to the vertical, as is well known in the art and illustrated in the applicant's referenced patent application Ser. No. 867,139.

After the sheet 50 has been formed in the rolling device 14, it proceeds into the multiple roll pipe forming device 16. With the exception of the differences discussed below, the multiple roll pipe forming device 16 is identical to that described in detail in the applicant's U.S. Pat. No. 4,070,886.

Figure 9:
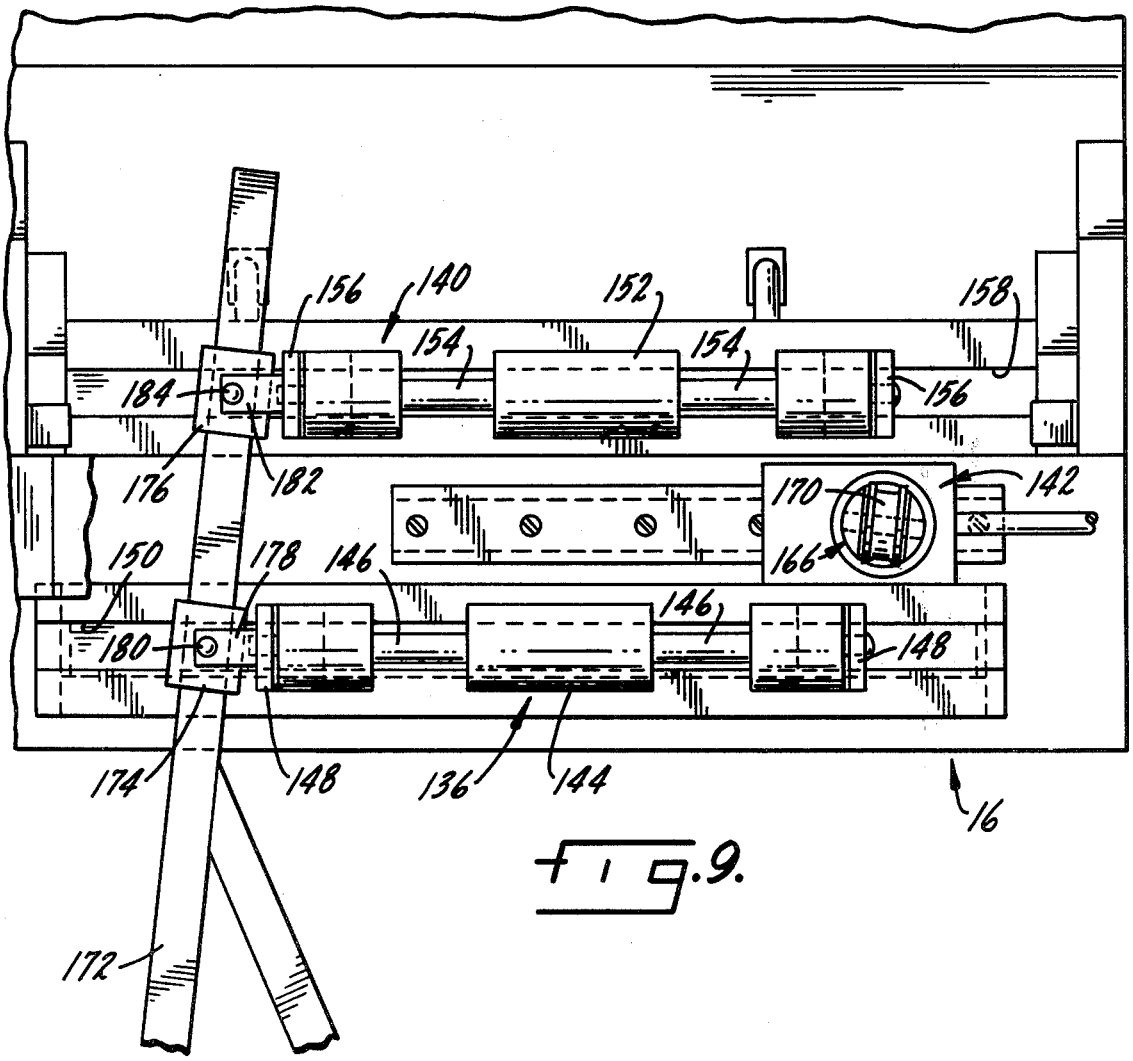
FIG. 9 is a partial top plan illustration of the pipe forming apparatus shown in FIG. 8 with the horn and horn roll removed for clarity of explanation.
Figure 8:
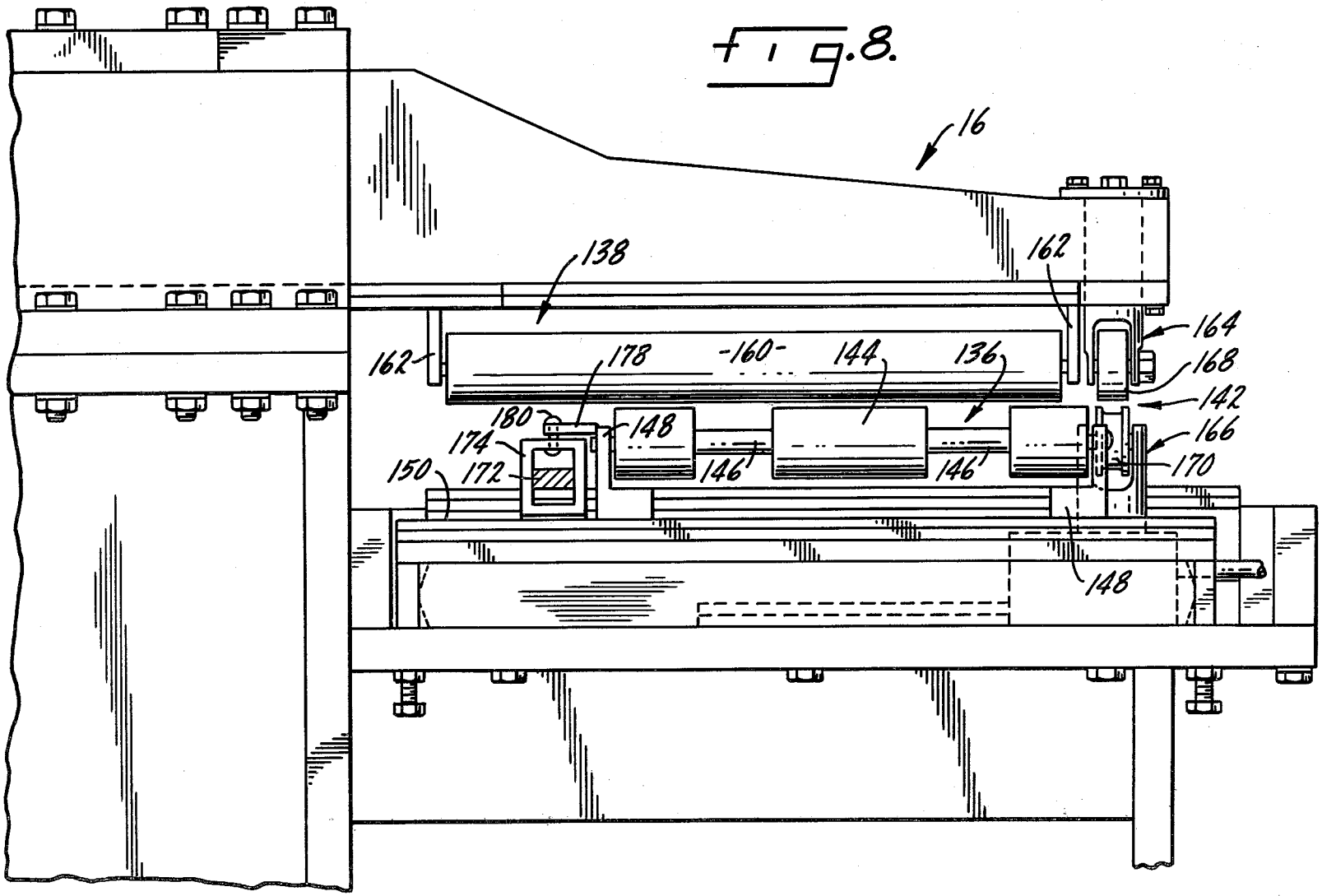
FIG. 8 is an enlarged front elevational illustration of the pipe forming device portion of the apparatus according to the invention.

The sheet 50 is curled into adjacent, helical convolutions and the seam elements 122 and 124 engaged and closed in the multiple roll pipe forming device 16. Turning to FIGS. 8 and 9, an enlarged portion of the pipe forming device 16 is illustrated, showing a lead roll assembly 136, a horn roll assembly 138, a buttress roll assembly 140, and a seaming roll assembly 142.

The lead roll assembly 136 is composed of a cylindrical roll 144 having a pair of annular gaps 146 located therein in registration with each of the impressions formed in the reinforced sheet 50. Each of the gaps is of a sufficient depth to accommodate the trapezoidal impressions 102 and is substantially wider than the width of the impressions in order to accommodate the angular relationship between the longitudinal axis of the reinforced sheet and the axis of the roll 144. In this manner, varying diameter convolutions can be accommodated by the pipe forming device 16 without changing the roll 144.

The roll 144 is maintained for rotation within a pair of support brackets 148 located at the opposite ends of the roll. The brackets 148, in turn, are mounted for horizontal sliding along a channel 150. Although the brackets 148 are shown as individual members, they could be connected beneath the cylinder 144 to form a single, yoke-shaped support bracket 148, if necessary.

The buttress roll assembly 140 is constructed in the same manner as the lead roll assembly 136. It includes a cylindrical roll 152 having a pair of annular gaps 154 and a pair of support brackets 156 for the roll 152 located at opposite ends of the roll along a channel 158.

The horn roll assembly 138 is composed of a stationary cylindrical roll 160 mounted for rotation between a pair of end brackets 162. Alternatively, the horn roll can be composed of a plurality of individual rollers as described in the applicant's foregoing U.S. patent application Ser. No. 867,139.

The seaming roll assembly 142 is composed of an upper lock seaming roll 164 and a lower lock seaming roll 166. The upper roll 164 includes a flat roller 168 and the lower roll 166 includes a roller 170 shaped to accommodate the depression 126 formed in the right-hand margin of the sheet 50. Greater detail as to the adjustability features of the seaming roll assembly 142 can be obtained from the applicant's U.S. Pat. No. 4,070,886.

An alternative feature which may be incorporated into the apparatus of the present invention is the frame-varying apparatus of the applicant's U.S. Pat. No. 4,070,886. As illustrated in FIGS. 1, 8 and 9, a frame member 172, attached to the exit end 46 of the carriage 26, extends into the multiple roll pipe forming device 16, passing through pivotal adjustment blocks 174 and 176 attached to the respective lead roll and buttress roll assemblies 136 and 140.

The adjustment block 174 is disposed about the frame member 172 and is attached to the support bracket 148 by a horizontal bar 178 and a pivot pin 180. Similarly, the block 176 surrounds the frame member 172 and is attached to the left bracket 156 by means of a horizontal bar 182 and a pivot pin 184. The pivot pins 180 and 184 allow relative rotative movement between the frame member 172 and the lead and buttress roll assemblies, while the adjustment blocks 174 and 176 allow relative sliding between the frame member 172 and the lead and buttress roll assemblies when the angular position between the rolling device 14 and the multiple roll pipe forming device 16 is varied.

Figure 10:
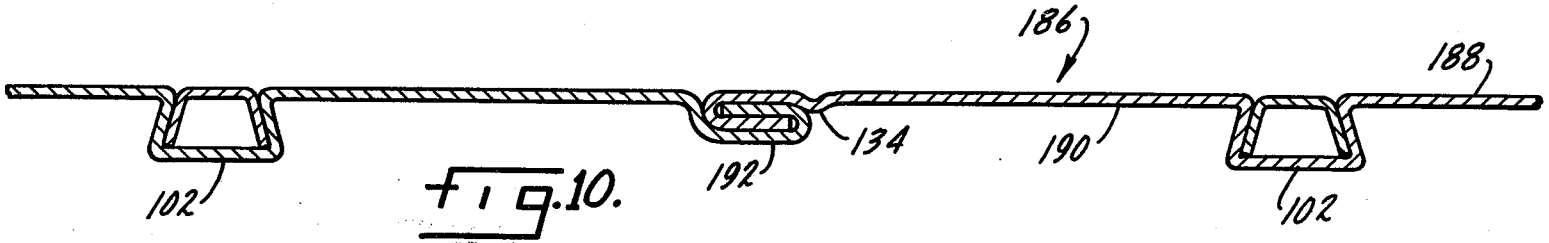
FIG. 10 is a broken cross-sectional illustration of a portion of a pipe product formed by the apparatus of the invention.
Figure 6A:
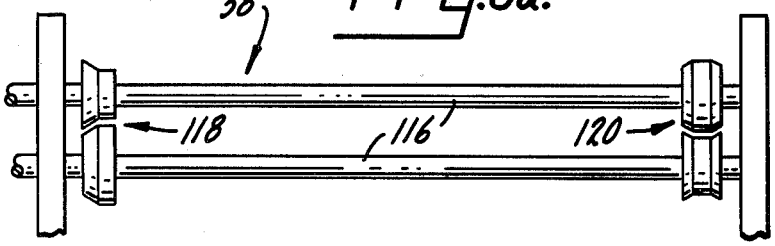
Figure 6B:
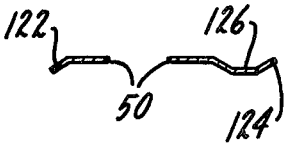
Figure 7A:
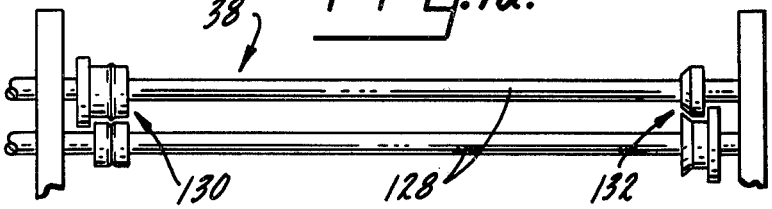
Figure 7B:
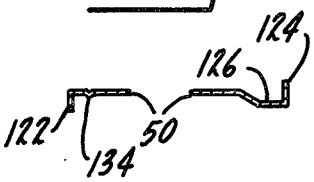

Illustrated in FIG. 10 is a broken sectional portion of a pipe 186 formed by the apparatus of the invention. The inner wall 188 of the pipe, composed of the curled sheet 50, is generally smooth. The outer wall 190 of the pipe includes the trapezoidal impressions 102 protruding therefrom and also a lock seam 192 which has been formed between the rollers of the seaming roll assembly 142 (FIG. 8). The heel 134 helps retain the lock seam 192 tightly closed. Greater detail of a pipe product can be obtained from the applicant's co-pending U.S. patent application entitled "Reinforced Smooth Flow Pipe" which was filed on the same data as the present application.

Although not illustrated in the drawings, it should be apparent that the pipe 186 may be formed with more or less than two trapezoidal impressions 102 by suitable modification of the rolling device 14 and multiple roll pipe forming device 16. Any number of the trapezoidal impressions may be employed depending on the width of the sheet 18 and the strength characteristics desired.

The apparatus 10 according to the invention is operated in the following manner. After the coils 18 and 20 are mounted on their respective spindles 22 and 24, the sheet 32 is drawn from the coil 18 and inserted within the forming stands 30 of the rolling device 14. At the same time, the strips 34 are withdrawn from their respective coils 20 and inserted within the upper rolls of the forming stands 30. As the apparatus is operated, the strips 34 join the sheet 32 and are lodged within the respective rectangular channels 98 just prior to passing through the completion stand 36. The completion stand 36 locks the reinforcement elements in place and thereafter the lock seam elements 122 and 124 and depression 126 are formed in the opposed marginal edges of the sheet. The sheet then proceeds into the pipe forming device 16, where the sheet is spiralled into adjacent, helical convolutions, the lock seam elements 122 and 124 interengaged, and the lock seam 192 closed by the seaming roll assembly 142. The pipe is then cut to desired lengths by a suitable pipe severence apparatus (not illustrated), such as that disclosed in the applicant's U.S. Pat. No. 3,815,455.

I claim:

1. Apparatus for manufacturing reinforced, spirally wound pipe having a generally smooth inner wall from an elongated flat sheet of ductile material and one or more narrow strips of ductile material, comprising a. rolling means for continuously forming one longitudinal, generally trapezoidal reinforced impression in the elongated flat sheet corresponding to each of the narrow strips, said rolling means having an entry end for acceptance of said flat sheet and an exit end for issuing the reinforced sheet, and consisting essentially of i. means to form one longitudinal, generally rectangular channel in the sheet corresponding to each of said narrow strips, ii. means to shape each narrow strip into a reinforcement element having a first continuous portion of a lesser width than the width of said rectangular channels and a second continuous portion comprising a pair of splayed legs extending from the outer edges of said first portion, iii. means to insert each of said strips into a corresponding one of said rectangular channels, and iv. means to close the walls of each of said channels about said strips to form said trapezoidal impressions, b. a forming device proximate said exit end for continuously curling said reinforced sheet into adjacent, helical convolutions, and c. means to join said adjacent convolutions.

2. An apparatus according to claim 1 in which said forming device comprises three individual rolls having parallel axes positioned transversely to the longitudinal axis of the sheet for curling said sheet into convolutions, two of said rolls being located without said helical convolutions and the third of said rolls being located within said convolutions.

3. An apparatus according to claim 2 in which each of said two rolls includes an annular gap located generally in registration with each of said impressions and of sufficient depth to accommodate said impressions, said gap being substantially wider than the width of said impression.

4. An apparatus according to claim 3 including means for horizontally shifting each of said two rolls to align said gaps with said impressions.

5. An apparatus according to claim 3 including means to vertically shift at least one of said two rolls to vary the diameter of said convolutions.

6. An apparatus according to claim 5 including means to alter the angular relationship between said rolling means and said forming device to change the helix angle of said convolutions to maintain the adjacency of said convolutions.

7. An apparatus according to claim 1 including means to form complementary lock seam elements in the marginal edges of the sheet prior to curling the reinforced sheet into helical convolutions.

8. An apparatus according to claim 7 in which said forming device includes means to interengage the complementary lock seam elements of adjacent convolutions of said reinforced sheet.

9. An apparatus according to claim 8 in which said means to engage includes a pair of seaming rolls in the forming device located to close the interengaged lock seam elements into a continuous lock seam.

10. A method of manufacturing reinforced, spirally wound pipe with a generally smooth inner wall from an elongated continuous sheet of ductile material and at least one continuous, narrow strip of ductile material, comprising the successive steps of a. forming one longitudinal, rectangular channel in said sheet corresponding to each of said strips of ductile material, b. shaping each of said strips into reinforcement elements having a first continuous portion of a lesser width than the width of said channel and a second continuous portion comprising a pair of splayed legs extending from the outer edges of the first portion, the height of each of said shaped strips being no greater than the depth of said channels, c. inserting each reinforcement element into a corresponding one of said rectangular channels, d. closing each of said channels about said elements to form longitudinal, reinforced impressions in the elongated sheet which have a trapezoidal cross-section, and e. curling said sheet into convolutions having said impressions forming ribs in the exterior wall of said convolutions.

11. The method of forming pipe according to claim 10 including the step of joining the edges of adjacent convolutions into a seam.

12. The method of forming pipe according to claim 10 including the further steps of forming partial lock-seam elements in the marginal edges of said sheet prior to curling said sheet into convolutions, and joining the partial lockseam elements into a lockseam subsequent to curling.

13. The method of forming pipe according to claim 10 in which the first-recited step includes at least one rolling operation wherein said rectangular channel is impressed into said sheet in a continuous, roll-forming process.

* * * * *